US008536770B2

(12) United States Patent
Kameda et al.

(10) Patent No.: US 8,536,770 B2
(45) Date of Patent: Sep. 17, 2013

(54) PLASMA JET SPARK PLUG

(75) Inventors: Hiroyuki Kameda, Aichi (JP); Yoshikuni Sato, Aichi (JP); Daisuke Nakano, Aichi (JP); Naofumi Yamamura, Aichi (JP); Daisuke Kasahara, Aichi (JP)

(73) Assignee: NGK Spark Plug Co., Ltd. (JP)

( * ) Notice: Subject to any disclaimer, the term of this patent is extended or adjusted under 35 U.S.C. 154(b) by 222 days.

(21) Appl. No.: 12/998,934

(22) PCT Filed: Dec. 22, 2009

(86) PCT No.: PCT/JP2009/007105

§ 371 (c)(1),
(2), (4) Date: Jun. 17, 2011

(87) PCT Pub. No.: WO2010/073609

PCT Pub. Date: Jul. 1, 2010

(65) Prior Publication Data

US 2011/0254429 A1 Oct. 20, 2011

(30) Foreign Application Priority Data

Dec. 26, 2008 (JP) ..... 2008-333152

(51) Int. Cl.
*H01T 13/20* (2006.01)

(52) U.S. Cl.
USPC ..... 313/141; 313/118; 313/132; 313/136; 313/137; 313/139

(58) Field of Classification Search
USPC ..... 313/118, 132, 136, 137, 139, 141
See application file for complete search history.

(56) References Cited

U.S. PATENT DOCUMENTS

| | | | | | |
|---|---|---|---|---|---|
| 2,182,061 | A | * | 12/1939 | Sparkes | 313/11.5 |
| 4,388,549 | A | * | 6/1983 | Bensman | 313/138 |
| 4,396,855 | A | * | 8/1983 | Imai et al. | 313/139 |
| 4,487,192 | A | * | 12/1984 | Anderson et al. | 123/654 |
| 4,631,451 | A | * | 12/1986 | Anderson et al. | 315/209 R |
| 4,713,574 | A | * | 12/1987 | Scott | 313/130 |
| 4,795,937 | A | * | 1/1989 | Wagner et al. | 313/130 |
| 4,870,319 | A | * | 9/1989 | Benedikt et al. | 313/137 |
| 6,559,578 | B1 | * | 5/2003 | Herden et al. | 313/136 |

(Continued)

FOREIGN PATENT DOCUMENTS

| | | |
|---|---|---|
| EP | 1 788 235 A2 | 5/2007 |
| JP | 1267984 | 10/1989 |

(Continued)

OTHER PUBLICATIONS

Form PCT/ISA/210—Int'l Search Report (from corresponding Int'l Patent App. No. PCT/JP2009/007105—English version only); 1 page.

(Continued)

*Primary Examiner* — Nimeshkumar Patel
*Assistant Examiner* — Thomas A Hollweg
(74) *Attorney, Agent, or Firm* — Kusner & Jaffe

(57) ABSTRACT

A plasma jet spark plug capable of preventing a channeling progress and having excellent heat conduction. The plasma jet spark plug comprised of: a ceramic insulator having a small diameter portion which assumes a linear shape in an axial direction, and a center electrode has an outer diameter increasing in the order of a frontmost portion, a step portion, a front end portion and a body portion.

9 Claims, 13 Drawing Sheets

(56) References Cited

U.S. PATENT DOCUMENTS

| | | | | |
|---|---|---|---|---|
| 6,580,202 | B1 * | 6/2003 | Pollner | 313/145 |
| 6,922,007 | B2 * | 7/2005 | Geier et al. | 313/143 |
| 7,328,677 | B2 * | 2/2008 | Hagiwara et al. | 123/143 B |
| 7,714,488 | B2 | 5/2010 | Nagasawa et al. | 313/130 |
| 2005/0227567 | A1 * | 10/2005 | Geier et al. | 445/7 |
| 2007/0221156 | A1 | 9/2007 | Hagiwara et al. | 123/143 |
| 2007/0221157 | A1 | 9/2007 | Hagiwara et al. | 123/143 |
| 2008/0018216 | A1 * | 1/2008 | Camilli | 313/141 |
| 2008/0121200 | A1 | 5/2008 | Kato et al. | 123/143 |

FOREIGN PATENT DOCUMENTS

| | | |
|---|---|---|
| JP | 2006294257 | 10/2006 |
| JP | 2007287666 | 11/2007 |
| JP | 2008-153190 | 7/2008 |

OTHER PUBLICATIONS

European Search Report (from corresponding European Patent App. No. 09834417.9, issued on Apr. 3, 2013; 7 pages.

* cited by examiner

PLASMA JET SPARK PLUG

FIELD OF THE INVENTION

The present invention relates to a plasma jet spark plug used for generating plasma and igniting an air-fuel mixture in an internal combustion engine.

BACKGROUND OF THE INVENTION

Conventionally, an internal combustion engine for an automobile engine uses a spark plug for igniting an air-fuel mixture by means of spark discharge. In recent years, high output and low fuel consumption have been required of internal combustion engines. To fulfill such requirements, a plasma jet spark plug capable of providing quick propagation of combustion and reliably igniting even a lean air-fuel mixture having a higher ignition-limit air-fuel ratio has been developed.

Such a plasma jet spark plug has a structure in which an insulator formed of ceramics or the like surrounds a spark discharge gap between a center electrode and a ground electrode, thereby forming a small-volume discharge space (cavity). Taking an example of an ignition system of a plasma jet spark plug, in igniting an air-fuel mixture, first, a high voltage is applied between the center electrode and the ground electrode so as to perform spark discharge. By virtue of associated occurrence of dielectric breakdown, current can flow therebetween at a relatively low voltage. Thus, through transition of a discharge state effected by further supply of electric, plasma is generated within the cavity. The generated plasma is ejected through a hole (i.e., orifice), thereby igniting the air-fuel mixture.

In the conventional plasma jet spark plug described in Japanese Patent Application Laid-Open (kokai) No. 2007-287666, an inner surface of an insulator has a stepped portion so as to form a reduced space in the cavity, whereby sufficient ignitability is achieved with about 50-200 mJ of energy. Further, in order to extend a plasma ejected distance and improve ignitability, a plasma jet spark plug according to Japanese Patent Application Laid-Open (kokai) No. 2006-294257 has a cavity of 10 $mm^3$ or less in volume and a ratio of a length to a diameter of the cavity with 2 or more. Further, a distance between a center electrode and a ground electrode is 3 mm or less.

However, since the plasma jet spark plug disclosed in Japanese Patent Application Laid-Open (kokai) No. 2007-287666 includes an insulator having a stepped inner wall therein, channeling (a channel formed due to electric discharge or the like) phenomenon tends to occur and significant deterioration in ignitability is likely to result.

Further, Japanese Patent Application Laid-Open (kokai) No. 2006-294257 discloses a plasma jet spark plug in which a distance between a center electrode and a ground electrode is 3 mm or less, and the center electrode has $\phi$1.5 mm or less. Thus, since the center electrode assumes a long and thin shape, the heat conduction (magnitude of heat decline) of a front end of the center electrode deteriorates, resulting in lowering durability of the center electrode. When the front end of the center electrode has poor heat conduction, the front end of the center electrode is likely to be abraded and eroded, which is prone to cause an oxidization of the front end during the spark discharge at high temperature.

Therefore, the present invention has been achieved in order to solve the above-mentioned problems. An advantage of the invention is a plasma jet spark plug capable of preventing channeling progress and having excellent heat conduction.

SUMMARY OF THE INVENTION

The present invention has been achieved in order to solve at least a part of above-mentioned problems, and the following mode and aspects can be realized.

Aspect 1

In accordance with a first aspect of the present invention, there is provided a plasma jet spark plug comprising: a cylindrical insulator having an axial bore in an axis direction. A rod-like center electrode is accommodated in the axial bore of the insulator. A plate-like ground electrode is disposed on a front end of the insulator. The center electrode has a body portion, and a front end portion having an outer diameter smaller than that of the body portion. The front end portion is located on a front end side with respect to the body portion. A frontmost portion has an outer diameter smaller than that of the front end portion and is located on a front end side with respect to the front end portion. A portion of the insulator where the axial bore is formed has an accommodating portion having an inner diameter smaller than the outer diameter of the body portion of the center electrode. The accommodating portion accommodates therein at least the front end portion of the center electrode. A small diameter portion having an inner diameter smaller than the outer diameter of the front end portion of the center electrode and smaller than the inner diameter of the accommodating portion. The small diameter portion located on the front end side with respect to the accommodating portion and accommodating therein at least the frontmost portion of the center electrode. A front end of the center electrode is located on a rear side with respect to a front end of the insulator in the small diameter portion, and the front end of the center electrode forms a cavity with an inner circumference of the small diameter portion. The ground electrode has an opening for use in communicating the cavity and an outside air. The small diameter portion in the axis direction assumes a linear shape.

Aspect 2

In accordance with a second aspect of the present invention, there is provided a plasma jet spark plug as described above, further comprising: wherein the portion of the insulator where the axial bore is formed further includes a first step portion located between the accommodating portion and the small diameter portion, and wherein the following relationship is satisfied: $0.2 \leqq (2c)/(a+b) \leqq 4$, where "a" represents a distance between a first intersection and a second intersection. The first intersection is an intersection of a first straight line drawn from an inner circumference of the opening of the ground electrode in the axis direction and the front end of the insulator. The second intersection is an intersection of the first straight line and the first step portion of the insulator, when the inner diameter of the opening of the ground electrode is smaller than the outer diameter of the front end portion of the center electrode and is larger than the inner diameter of the small diameter portion. The letter "a" represents a length of an inner circumference of the small diameter portion in the axis direction when the inner diameter of the opening of the ground electrode is smaller than the outer diameter of the front end portion of the center electrode and is smaller than the inner diameter of the small diameter portion. The letter "b" represents a distance between a third intersection and a fourth intersection. The third intersection is an intersection of a second straight line drawn from the outer circumference of the front end portion of the center electrode in the axis direction and the first step portion of the insulator, and the fourth intersection is an intersection of the second straight line and the front end of the insulator. The letter "c" represents an overlapping area of the ground electrode with the front end portion of the center electrode when the ground electrode and the front end portion of the center electrode are projected in the axis direction.

Aspect 3

In accordance with a third aspect of the present invention, there is provided a plasma jet spark plug according to aspect 1 or 2, wherein the inner diameter of the opening of the ground electrode falls within a range from 75% to 120% of the inner diameter of the front end of the small diameter portion of the insulator.

Aspect 4

In accordance with a fourth aspect of the present invention, there is provided a plasma jet spark plug according to one of aspects 1 to 3, wherein the center electrode serves as a negative electrode.

Aspect 5

In accordance with a fifth aspect of the present invention, there is provided a plasma jet spark plug according to one of aspects 1 to 4, wherein an overlapping-amount of the small diameter portion with the frontmost portion in the axis direction falls within the range from 0.5 to 3 mm.

Aspect 6

In accordance with a sixth aspect of the present invention, there is provided a plasma jet spark plug according to one of aspects 1 to 5, wherein the center electrode further includes a second step portion between the front end portion and the frontmost portion, and wherein angles θ1 and θ2 satisfies the following relationship:

$$\theta 1<\theta 2,$$

where θ1 represents an angle formed by the first step portion and the accommodating portion, and where θ2 represents an angle formed by the second step portion and the front end portion.

Aspect 7

In accordance with a seventh aspect of the present invention, there is provided a plasma jet spark plug according to one of aspects 1 to 6, wherein the following relationships are satisfied:

$$R\leqq 2.5\ \text{mm}^3,\ \text{and}\ S/N\geqq 0.3,$$

where "R" represents a volume of the cavity, where "S" represents a length of the cavity in the axis direction, and where "N" represents an inner diameter of the small diameter portion.

Aspect 8

In accordance with an eighth aspect of the present invention, there is provided a plasma jet spark plug according to one of aspects 1 to 7, wherein a gap is provided between the first step portion and the second step portion.

Aspect 9

In accordance with a ninth aspect of the present invention, there is provided a plasma jet spark plug according to one of aspects 1 to 8, wherein at least a tip end of the center electrode is made of pure metal or an alloy with a melting point of 2400 degrees C. or more.

Aspect 10

In accordance with a tenth aspect of the present invention, there is provided a plasma jet spark plug according to one of aspects 1 to 9, wherein at least the tip end of the center electrode is made of tungsten or a tungsten alloy.

The above-mentioned various modes and aspects may be appropriately combined or partially omitted.

In the plasma jet spark plug according to aspect 1, the small diameter portion of the insulator assumes a linear shape in the axis direction. Thus, a discharge path in the cavity also assumes a linear shape, whereby electrical field intensity inside of the insulator can be weakened, as compared to the case where a discharge path assumes a curved shape or an "L" shape. As a result, progress of the channeling phenomenon can be prevented.

Moreover, since the center electrode has the outer diameter increasing in the order of the frontmost portion, the front end portion and the body portion, the heat received at the tip end of the center electrode can be efficiently conducted from the frontmost portion to the body portion. Thus, the heat conduction of the center electrode can be improved. As a result, the durability of the center electrode can be secured.

In the plasma jet spark plug according to aspect 2, a portion surrounding the cavity is formed so that the distances "a", "b" and the area "c" satisfy the following relationship: $0.2\leqq(2c)/(a+b)\leqq 4$.

In this way, a portion of the insulator which is sandwiched between the center electrode and the ground electrode (i.e., the portion surrounding the cavity) has a suitable value of an electrostatic capacity. Therefore, so-called "plasma current absence" can be prevented.

In the plasma jet spark plug according to aspect 3, the inner diameter of the opening of the ground electrode falls within a range from 75 to 120% of the inner diameter of the front end of the small diameter portion of the insulator. In this way, channeling progress occurs almost uniformly on the inner circumference of the small diameter portion in the cavity even if the channeling phenomenon is generated. Since the channeling progress is consistent, the durability of the plasma jet spark plug can be improved, and excellent ignitability thereof is also achievable.

In the plasma jet spark plug according to aspect 4, the center electrode serves as the negative electrode. In this way, the front end portion of the small diameter portion of the insulator is unlikely to be eroded by the channeling phenomenon. In the inner circumference of the small diameter portion, a portion close to the front end of the center electrode tends to be eroded. In such a case, the discharge path first goes to the outer circumference side and then to the inner circumference side in the radial direction, resulting in preventing deterioration in ignitability due to channeling progress.

In the plasma jet spark plug according to aspect 5, the overlapping amount "d" of the frontmost portion of the center electrode with the small diameter portion of the insulator is within the range from 0.5 to 3 mm. In this way, a form of electric discharge becomes a creeping discharge, which results in preventing an increase in spark discharge voltage.

In the plasma jet spark plug according to aspect 6, the angles θ1 and θ2 have the relationship of θ1<θ2, where θ1 is the angle formed by the first step portion and the accommodating portion, and where θ2 is the angle formed by the second step portion and the front end portion. Thus, the erosion of the first step portion and the small diameter portion can be prevented, and deterioration in heat conduction of the center electrode is also prevented. Further, a combustion gas is unlikely to be pooled between the step portions.

In the plasma jet spark plug according to aspect 7, the volume R of the cavity is defined as $R\leqq 2.5\ \text{mm}^3$, and the ratio of the length S of the cavity to the inner diameter N of the small diameter portion is defined as $S/N\geqq 0.3$. In this way, the excellent ignitability is achievable by defining the shape of the cavity.

In the plasma jet spark plug according to aspect 8, the gap is provided between the first step portion of the insulator and the second step portion of the center electrode. In this way, the heat in the end portion of the insulator is unlikely conducted to the center electrode, whereby an increase in temperature of the tip end of the center electrode can be prevented.

In the plasma jet spark plug according to aspect 9, at least the tip end of the center electrode is made of pure metal or an alloy with a melting point of 2400 degrees C. or more. In this way, when plasma current is fed to the plasma jet spark plug, the tip end of the center electrode is unlikely to melt.

In the plasma jet spark plug according to aspect 10, at least the tip end of the center electrode is made of tungsten or a tungsten alloy.

DETAILED DESCRIPTION OF PREFERRED EMBODIMENTS

The present invention will now be described based on an embodiment in the following order.

Figure 1:
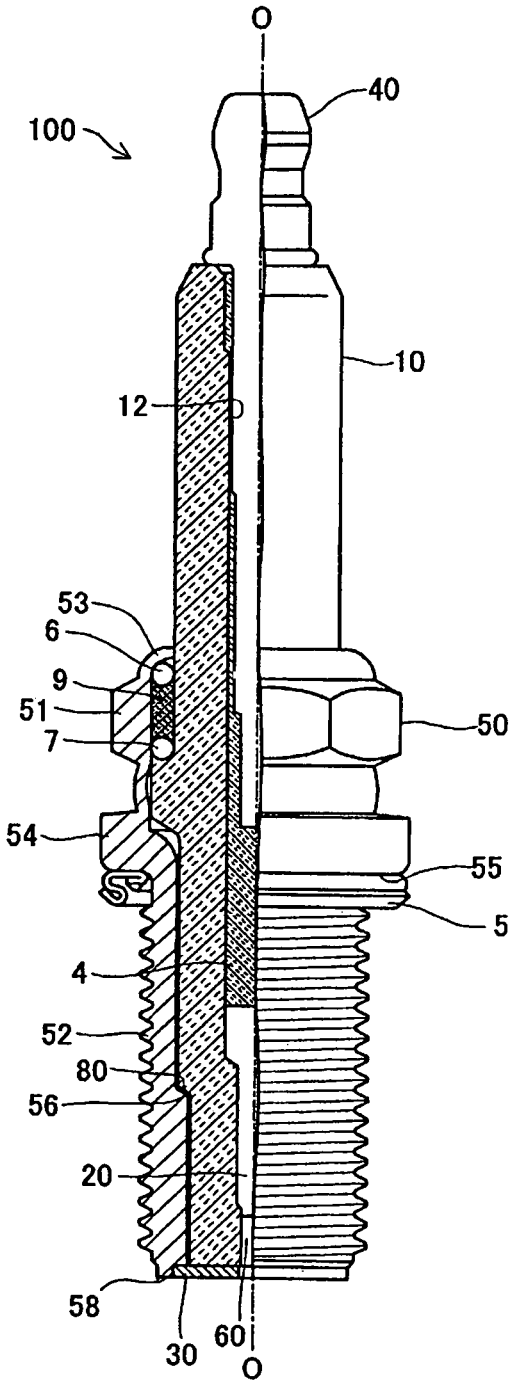
FIG. 1 is a sectional view of a plasma jet spark plug 100 according to an embodiment of the present invention.
Figure 2:
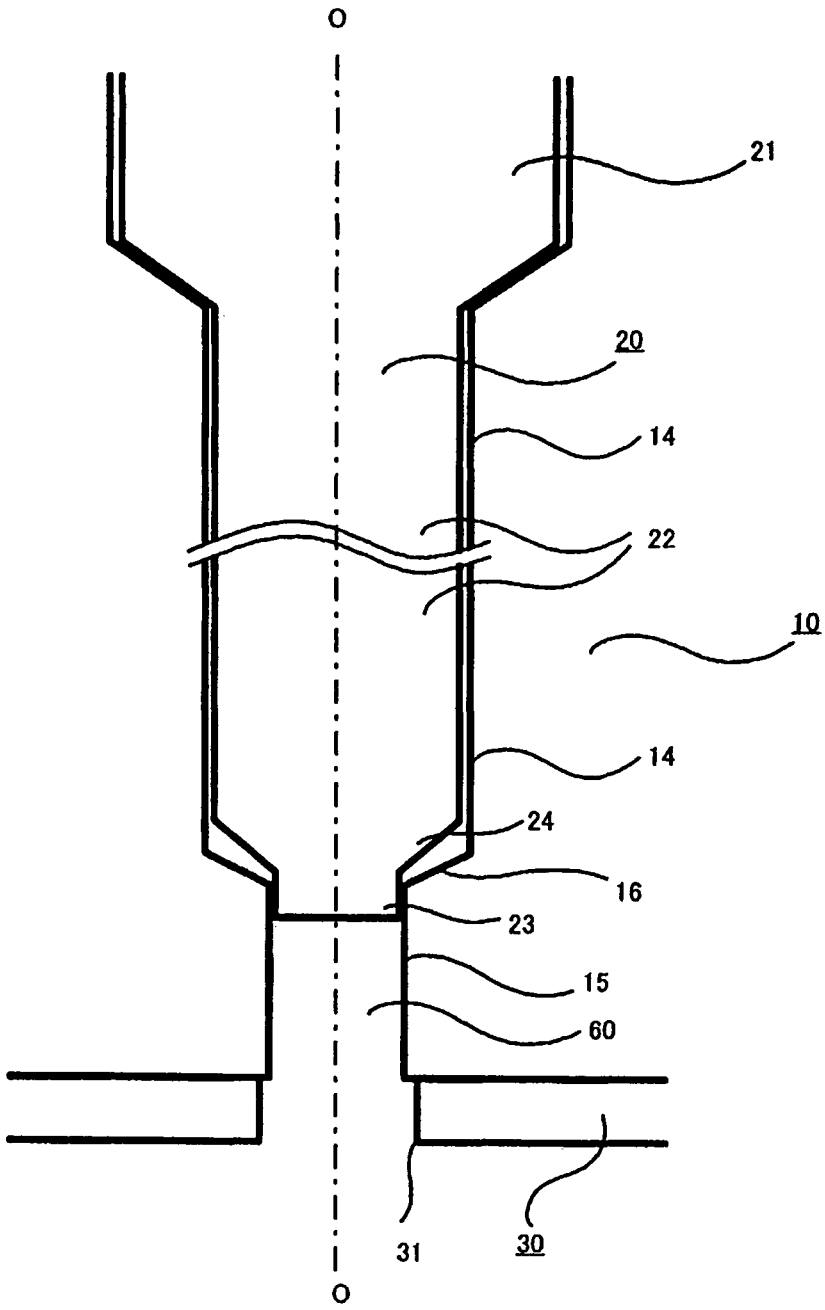
FIG. 2 is an enlarged sectional view showing around a center of the end portion of the plasma jet spark plug 100 of FIG. 1.

A. Configuration of plasma jet spark plug
B. Operation of plasma jet spark plug
C. Features of an embodiment
C-1. Shape of Ceramic Insulator Small Diameter Portion
C-2. Shape of Center Electrode
C-3. Electrostatic capacity around Cavity
C-4. Ground Electrode and Inner Diameter of Small Diameter Portion
C-5. Polarity of Center Electrode
C-6. Overlapping of Ceramic Insulator Small Diameter Portion with a Center Electrode Frontmost portion
C-7. Angle of a step portion
C-8. Shape of a cavity
C-9. Gap between step portions
C-10. Material of a center electrode front end
D. Modification A. Configuration of Plasma Jet Spark Plug FIG. 1 is a sectional view of a plasma jet spark plug 100 according to an embodiment of the present invention. FIG. 2 is an enlarged sectional view of the end portion of the plasma jet spark plug 100 of FIG. 1. In addition, the direction of the axis O of the plasma jet spark plug 100 in FIG. 1 is referred to as the vertical direction, and the lower side of the plasma jet spark plug 100 in FIG. 1 is referred to as the front end side of the plasma jet spark plug 100, and the upper side as the rear end side of the plasma jet spark plug 100.

As shown in FIGS. 1 and 2, the plasma jet spark plug 100 has a cylindrical ceramic insulator 10 which has an axial bore 12 in the axial O direction. A center electrode 20 is disposed in the axial bore 12 of the ceramic insulator 10. A plate-like ground electrode 30 is disposed at a front end of the ceramic insulator 10. A terminal fitting 40 is disposed at a rear end of the ceramic insulator 10, and a metal shell 50 holds the ceramic insulator 10 therein.

As is well known, the ceramic insulator 10 is an insulative member which is made of sintered alumina or the like and has a dielectric constant between 8 to 11. In the outer appearance of the ceramic insulator 10, a flange portion is provided at the generally center in the axial O direction. The flange portion serves as a border of the rear end side and the front end side of the ceramic insulator 10. The front end side of the ceramic insulator 10 with respect to the flange portion assumes a step-like shape, and a front end portion of the ceramic insulator has a further reduced diameter.

The center electrode 20 is a rod-like electrode and made of a nickel system alloy, such as INCONEL 600 or 601 (trade name). The center electrode 20 has a core metal (not shown) made of highly thermal conductive copper or the like that is embedded therein. Further, a disc-like electrode tip (not shown) made of tungsten or a tungsten alloy is welded to the front end of the center electrode 20. As best seen in FIG. 2, the center electrode 20 has a body portion 21, a front end portion 22 located in the front end side with respect to the body portion 21, a frontmost portion 23 located in the front end side with respect to the front end portion 22, and a step portion 24 located between the front end portion 22 and the frontmost portion 23. An outer diameter of the front end portion 22 is smaller than that of the body portion 21, and an outer diameter of the frontmost portion 23 is smaller than that of the front end portion 22. A portion between the body portion 21 and the front end portion 22 assumes a flange shape, and this flange portion comes into contact with the step portion of the ceramic insulator 10 in the axial bore 12 so as to position the center electrode 20 within the axial bore 12.

Figure 4:
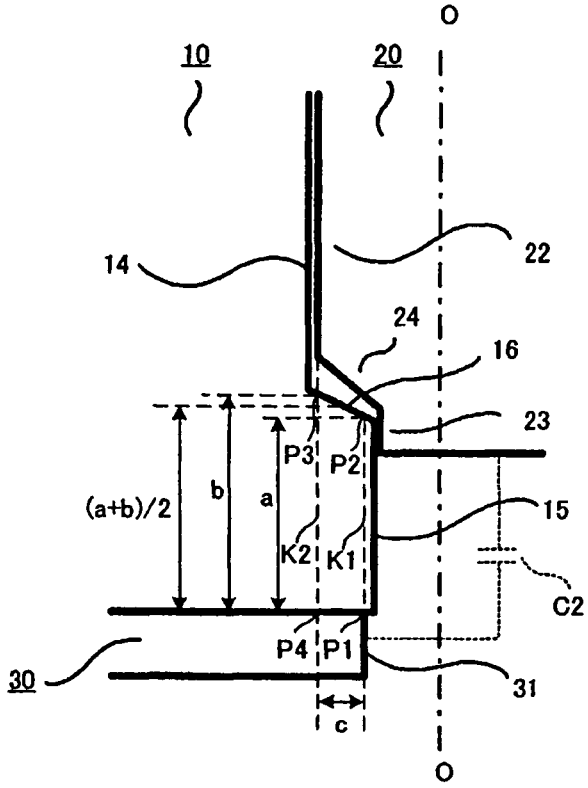
FIG. 4 is an enlarged sectional view showing a portion of a ceramic insulator 10 sandwiched between the center electrode 20 and the ground electrode 30 in FIG. 2.

Referring now to FIG. 4 that shows a portion of the axial bore 12 of the ceramic insulator 10, the ceramic insulator 10 is comprised of: an accommodating portion 14 for accommodating the front end portion 22 of the center electrode 20. The accommodating portion 14 is provided in the front end side with respect to the above-mentioned step portion. Ceramic insulator 10 further comprises a small diameter portion 15 where the frontmost portion 23 of the center electrode 20 is disposed, and a step portion 16 located between the accommodating portion 14 and the small diameter portion 15. The inner diameter of the small diameter portion 15 is smaller than that of the accommodating portion 14 and smaller than the outer diameter of the front end portion 22 of the center electrode 20. In the small diameter portion 15 of the ceramic insulator 10, the front end of the center electrode 20 is positioned. As shown in the drawing, the front end of the center electrode 20 is disposed near the rear end side of small diameter portion 15 with respect to the front end of the ceramic insulator 10. The front end of the center electrode 20 forms a small space (a cavity 60, best seen in FIG. 2) with the front end of the center electrode 20 and the inner circumference of the small diameter portion 15. The cavity 60 serves as a discharge space.

Further, the ground electrode 30 is made of a metal excellent in anti-spark erosion, such as an Ir system alloy. The ground electrode 30 assumes a disk plate shape with 0.3 to 1 mm in thickness. In the center of the ground electrode 30, an opening 31 is formed so that the cavity 60 can communicate with outside air. The ground electrode 30 is engaged with a engagement portion 58 formed in the inner circumferential face of the front end of the metal shell 50, while being in contact with the front end of the ceramic insulator 10 (as best seen in FIG. 1). The ground electrode 30 is integrally fixed to the metal shell 50 by laser welding an outer circumferential edge of the ground electrode 30.

The center electrode 20 is electrically connected to the terminal fitting 40 located on the rear end side of plasma jet spark plug 100 through a conductive seal material 4 which is made of metal-glass composition and disposed in the axial bore 12. The center electrode 20 and the terminal fitting 40 are fixed and electrically conductive through the seal material 4 in the axial bore 12. In addition, the seal material 4 is disposed in the position as far as possible from the front end portion of the center electrode 20 so as not to melt by heat. Moreover, a high voltage cable (not shown) is connected to the terminal fitting 40 through a plug cap (not shown).

The metal shell 50 is a cylindrical metal shell for fixing the plasma jet spark plug 100 to an engine head (not illustrated) of an internal combustion engine. The metal shell 50 holds therein and surrounds the insulator 10. The metal shell 50 is formed of an iron-based material and has a tool engagement portion 51, with which a plug wrench (not illustrated) is engaged, and a threaded portion 52 on which are formed external threads that are dimensioned to engage with a mounting hole (not shown) of the engine head.

The caulking portion 53 is formed in the rear end side with respect to the tool engagement portion 51 of the metal shell 50. Annular ring members 6 and 7 intervene between a portion of the metal shell 50 which extends from the tool engagement portion 51 to the caulking portion 53, and the rear end side of the insulator 10. A space between the annular ring members 6 and 7 is filled with a powder of talc 9. By means of caulking of the caulking portion 53, the insulator 10 is pressed frontward in the metal shell 50 via the ring members 6 and 7 and talc 9. By this procedure, the step portion of the insulator 10 is supported, via an annular packing 80 (best seen in FIG. 1), on a catching portion 56 of the metal shell 50 which is formed on the inner circumferential face of the metal shell 50, whereby the metal shell 50 and the insulator 10 are united together. At this time, the packing 80 provides a gas-tight seal between the metal shell 50 and the insulator 10, thereby preventing outflow of combustion gas. Moreover, a flange portion 54 is formed between the tool engagement portion 51 and the threaded portion 52, and a gasket 5 is fitted in the proximity of the rear end side of the threaded portion 52, i.e., to a seat face 55 of the flange 54.

B. Operation of Plasma Jet Spark Plug

Figure 3:
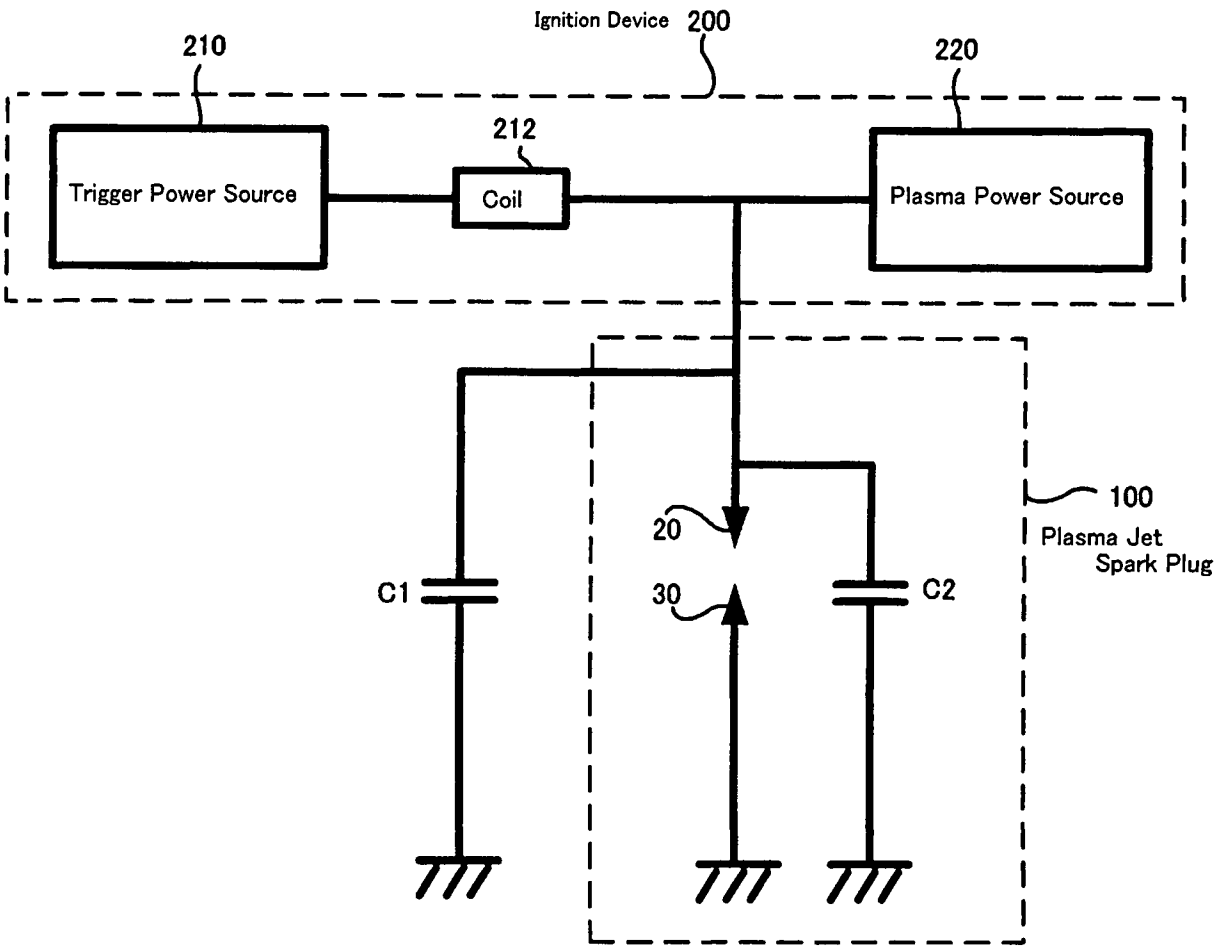
FIG. 3 is a block diagram showing an overview of an ignition unit used for operating the plasma jet spark plug of FIG. 1.

FIG. 3 is a block diagram showing an overview of an ignition unit used for operating the plasma jet spark plug of FIG. 1.

The plasma jet spark plug 100 is connected to an ignition unit 200 through the above-mentioned high voltage cable. The ignition unit 200 is equipped with a trigger power source 210 and a plasma power source 220 which are different systems. A plasma power source 220 having a capacity to supply 10 to 120 mJ of energy is used.

When a predetermined electric power from the trigger power source 210 is supplied to the plasma jet spark plug 100 through a coil 212 and the high voltage cable, in the plasma jet spark plug 100, the electric power is supplied to the center electrode 20 through the seal material 4 from the terminal fitting 40 to which the above-mentioned high voltage cable is connected. Thereby, spark discharge (breakdown) occurs in the spark discharge gap between the center electrode 20 and the ground electrode 30, and the spark discharge passes through the space or the wall of a cavity 60. In this way, when a dielectric breakdown occurs due to spark discharge, a discharge sustaining voltage serving as a voltage of the center electrode 20 falls immediately after the dielectric breakdown. At this time, plasma current is fed from the plasma power source 220 which is another system, and such energy induces plasma in the cavity 60. The thus-induced plasma is ejected from the opening 31 of the ground electrode 30 to ignite an air-fuel mixture in an internal combustion engine. In addition, in FIG. 3, "C1" indicates electrostatic capacity which the plasma jet spark plug 100 generally holds. "C2" will be described later.

C. Features of Embodiment

C-1. Shape of Small Diameter Portion of Ceramic Insulator

As shown in FIG. 2, in this embodiment, the small diameter portion 15 of the ceramic insulator 10 assumes a linear shape in the axis O direction.

Since the small diameter portion 15 in the axis O direction assumes the linear shape, the discharge path in the cavity 60 also assumes a linear shape. Thus, electrical field intensity inside of the ceramic insulator 10 can be weakened, as compared to the case where a discharge path assumes a curved shape or an "L" shape. As a result, progress of the channeling phenomenon can be prevented.

C-2. Shape of Center Electrode

As shown in FIG. 2, in this embodiment, the center electrode 20 has the outer diameter increasing in the order of the frontmost portion 23, the step portion 24, the front end portion 22 and the body portion 21. Therefore, the heat received at the tip end of the center electrode 20 can be efficiently conducted from the frontmost portion 23 to the body portion 21, and the heat conduction of the center electrode 20 can be improved. As a result, the durability of the center electrode 20 can be secured.

C-3. Electrostatic Capacity around Cavity

In this embodiment, relationships are defined with respect to the shape of a portion of the ceramic insulator 10 that is sandwiched between the center electrode 20 and the ground electrode 30, namely, a portion surrounding the cavity 60 (such as the small diameter portion 15 and the step portion 16) and the positional relationship between the center electrode 20 and the ground electrode 30 are such that the portion of the ceramic insulator 10 has a suitable electrostatic capacity "C2". However, as mentioned above, the dielectric constant of the ceramic insulator 10 falls within the range from 8 to 11.

FIG. 4 is an enlarged sectional view showing a portion of a ceramic insulator 10 sandwiched between the center electrode 20 and the ground electrode 30 in FIG. 2. As shown in FIG. 4, when an inner diameter of the opening 31 of the ground electrode 30 is smaller than the outer diameter of the front end portion 22 of the center electrode 20 and is larger than an inner diameter of the small diameter portion 15 of the ceramic insulator 10, "a" represents a distance between an intersection P1 and an intersection P2. The intersection P1 is an intersection of a straight line K1 that is drawn from the inner circumference of the opening 31 of the ground electrode 30 in the axis O direction and the front end of the ceramic insulator 10. The intersection P2 is an intersection of the straight line K1 and the step portion 16 of the ceramic insulator 10. Further, "b" represents a distance between an intersection P3 and an intersection P4. The intersection P3 is an intersection of a straight line K2 that is drawn from the outer circumference of the front end portion 22 of the center electrode 20 in the axis O direction and the step portion 16 of the ceramic insulator 10. The intersection P4 is an intersection of the straight line K2 and the front end of the ceramic insulator 10. Furthermore, "c" represents an overlapping area of the ground electrode 30 with the front end portion 22 of the center electrode 20 when the ground electrode 30 and the front end portion 22 of the center electrode 20 are projected in the axis O direction. A portion surrounding the cavity 60 is formed so that the thus-defined distances "a", "b" and the area "c" satisfy the following relationship:

$$0.2 \leqq (2c)/(a+b) \leqq 4.$$

In addition, when the inner diameter of the opening 31 of the ground electrode 30 is smaller than the outer diameter of the front end portion 22 of the center electrode 20 and is smaller than the inner diameter of the small diameter portion 15 of the ceramic insulator 10, the distance "a" represents a length of the inner circumference of the small diameter portion 15 in the axis O direction. Moreover, when the inner diameter of the opening 31 of the ground electrode 30 varies depending on the position in an inner circumference direction (e.g., a plurality of projections is provided in the inner circumference of the opening 31 as shown FIG. 9 (*d*) which will be mentioned later), the above-mentioned distance "a" is defined in each position and the average value thereof is applied to the above-mentioned relationship.

In this way, the portion (the small diameter portion 15, the step portion 16, or the like) surrounding the cavity 60 can have a suitable value of an electrostatic capacity C2, resulting in preventing, so-called "plasma current absence."

Using FIGS. 3 and 5, the principle of the plasma current absence prevention shall now be described.

In FIG. 3, when the plasma current is fed to the plasma jet spark plug 100 from the plasma power source 220 of the ignition unit 200, as mentioned above, generally the electric discharge phenomenon occurs at first between the center electrode 20 and the ground electrode 30 (between the plug gap) by the trigger power source 210. In a state that the center electrode 20 and the ground electrode 30 are electrically conductive, the discharge-sustaining voltage, that serves as a voltage of the center electrode 20 to the ground electrode 30, becomes, for example, −500V or more. In this way, an electric charge that is accumulated in a capacitor (not shown) can be at once fed as plasma current from the plasma power source 220. In addition, in FIG. 3, "C2" indicates an electrostatic capacity of the portion surrounding the cavity 60 as it mentioned above.

Figure 5A:
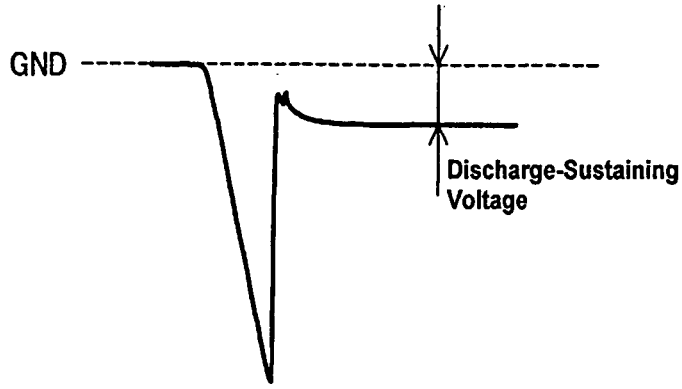
FIG. 5 is a waveform chart showing a waveform of a voltage of the center electrode against the ground electrode before and after electric discharge.
Figure 5B:
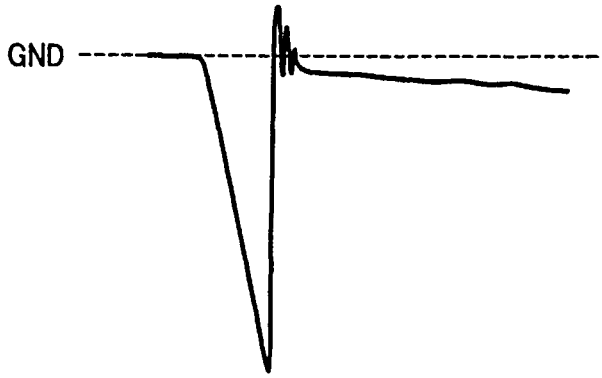
Figure 5C:
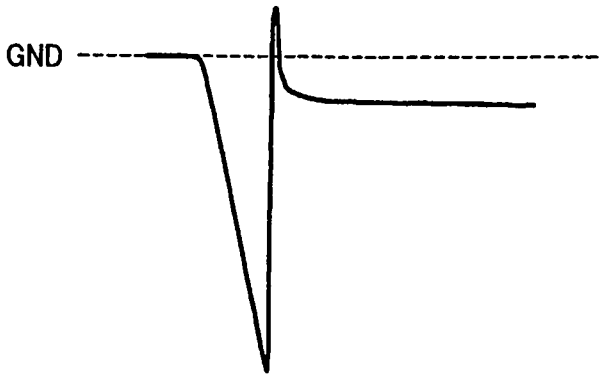

FIG. 5 is a waveform chart showing a waveform of a voltage of the center electrode against the ground electrode before and after electric discharge. FIG. 5(*a*) is a waveform of a conventional plasma jet spark plug. FIG. 5(*b*) is a waveform of the plasma jet spark plug 100 according to an embodiment. FIG. 5(*c*) is a waveform of an electrostatic capacity C2 of the portion surrounding the cavity 60, the waveform showing an excessive value.

As shown in FIG. 5(*a*), a conventional plasma jet spark plug has a tendency wherein a discharge-sustaining voltage sometimes becomes too high under a certain operating condition. In such a case, plasma current cannot be fed to a plasma jet spark plug, thereby causing a plasma current absence. On the other hand, the plasma jet spark plug 100 according to the embodiment can reduce the discharge-sustaining voltage as shown in FIG. 5(*b*), because the electrostatic capacity "C2" of the portion surrounding the cavity 60 has a suitable value as mentioned above. As a result, plasma current can be easily fed to the plasma jet spark plug 100. Moreover, the electric charge discharged at the time of spark discharge (breakdown) is again accumulated in the electrostatic capacity "C2" of the portion surrounding the cavity 60. As a result, since the voltage of the center electrode 20 varies greatly to an opposite direction (plus side), a feeding of plasma current is facilitated.

In the case where the distances "a" and "b" and the area "c" neither satisfy the relationships of $a<b$ nor $0.2<=(2c)/(a+b)<=4$, and in the case where the electrostatic capacity "C2" of the portion surrounding the cavity 60 is too high, a discharge-sustaining voltage serving as a voltage of the center electrode 20 becomes −500V or less, because an inductive current flows in from an inductor of the coil 212 of the trigger power source 210 as shown in FIG. 5(*c*). As a result, a feeding of plasma current cannot be conducted.

Figure 6:
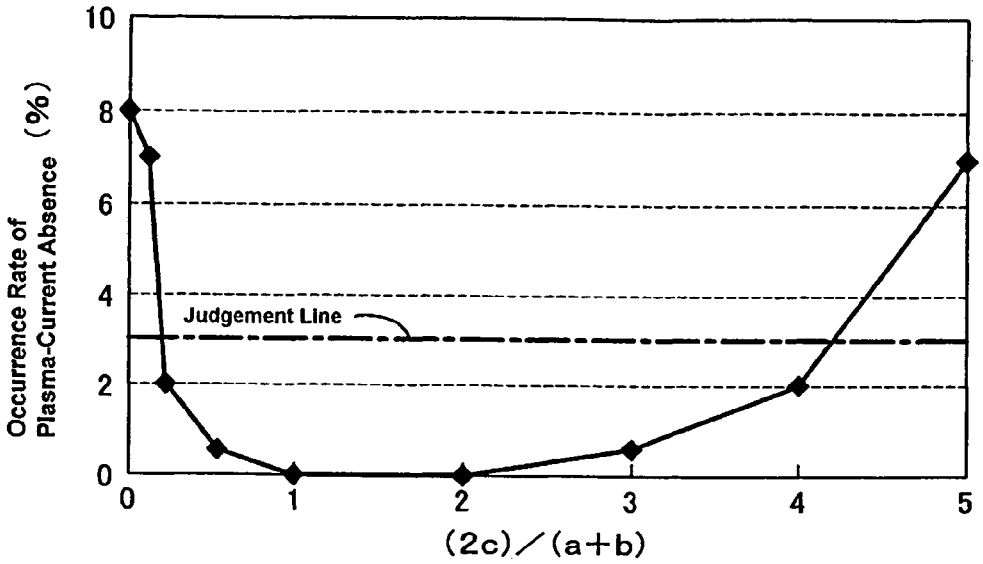
FIG. 6 is an explanatory view showing an example of the plasma current absence evaluation result according to an embodiment of the present invention.

Referring now to FIG. 6, an example of the plasma current absence evaluation results according to the embodiment will next be described. FIG. 6 is an explanatory view showing an example of the plasma current absence evaluation results according to the present embodiment. In FIG. 6, a vertical axis shows an occurrence rate of plasma current absence (%), and a horizontal axis shows a value of (2c)/(a+b) based on the above-defined distances "a", "b" and the area "c". In addition, the evaluation was conducted under 1.0 MPa chamber pressure, and a judgment line of the occurrence rate of plasma current absence was 3%.

As shown in FIG. 6, when the value was $2c/(a+b) \geqq 0.2$, the occurrence rate of the plasma current absence was 3% or less, whereby the number of the plasma current absence occurrences was sharply reduced. Further, when the value was within $1.0 \leqq (2c)/(a+b) \leqq 2.0$, the occurrence rate of the plasma current absence was 0%, which was an excellent rate. When the value was $(2c)/(a+b)>4$, the plasma current absence occurred because the electrostatic capacity "C2" of the portion surrounding the cavity 60 had a large value, causing an increase in the discharge-sustaining voltage after the spark discharge (breakdown).

C-4. Ground Electrode and Inner diameter of Small Diameter Portion

Figure 7:
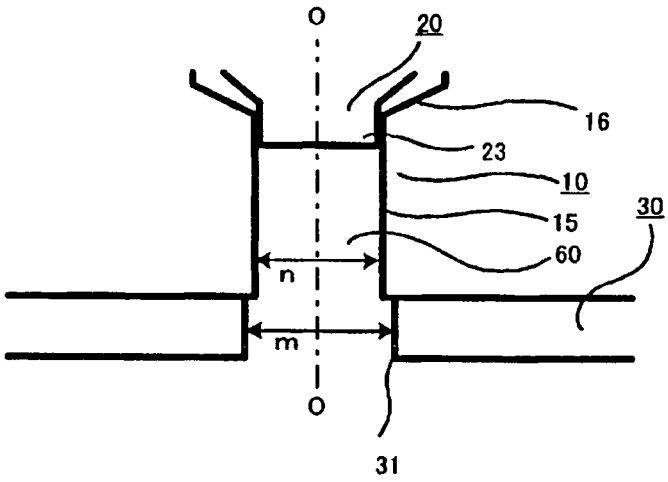
FIG. 7 is an enlarged sectional view showing an opening 31 of the ground electrode 30 and a small diameter portion 15 front end of the ceramic insulator 10 in FIG. 2.

FIG. 7 is an enlarged sectional view showing the opening 31 of the ground electrode 30 and the front end of small diameter portion 15 of the ceramic insulator 10 in FIG. 2. In this embodiment, the inner diameter "m" of the opening 31 of the ground electrode 30 shown in FIG. 7 falls within a range from 75% to 120% of an inner diameter "n" of the front end of the small diameter portion 15 of the ceramic insulator 10.

Thus, when a ratio of the inner diameter "m" of the opening 31 to the inner diameter "n" of the front end of the small diameter portion 15, i.e., an inner diameter of the cavity 60, falls within the above range, channeling progress occurs almost uniformly on the inner circumference of the small diameter portion 15 in the cavity 60 even if the channeling is generated. Therefore, since the channeling progress is consistent, the durability of the plasma jet spark plug 100 can be improved, and excellent ignitability thereof is achievable.

On the other hand, when the ratio of the inner diameter of the opening 31 to the inner diameter of the cavity 60 is beyond the above range, and when the inner diameter of the opening 31 is too small against the inner diameter of the cavity 60, the plasma ejected from the opening 31 is intercepted, which causes deterioration in ignitability. On the other hand, when the inner diameter of the opening 31 is too large against the inner diameter of the cavity 60, a discharge path assumes an "L" shape, which causes the channeling progress. A location where the channeling phenomenon occurs has a reduced distance between the ground electrode 30 and the center electrode 20, whereby the discharge path is concentrated on the location. As a result, the ignitability deteriorates.

Figure 8:
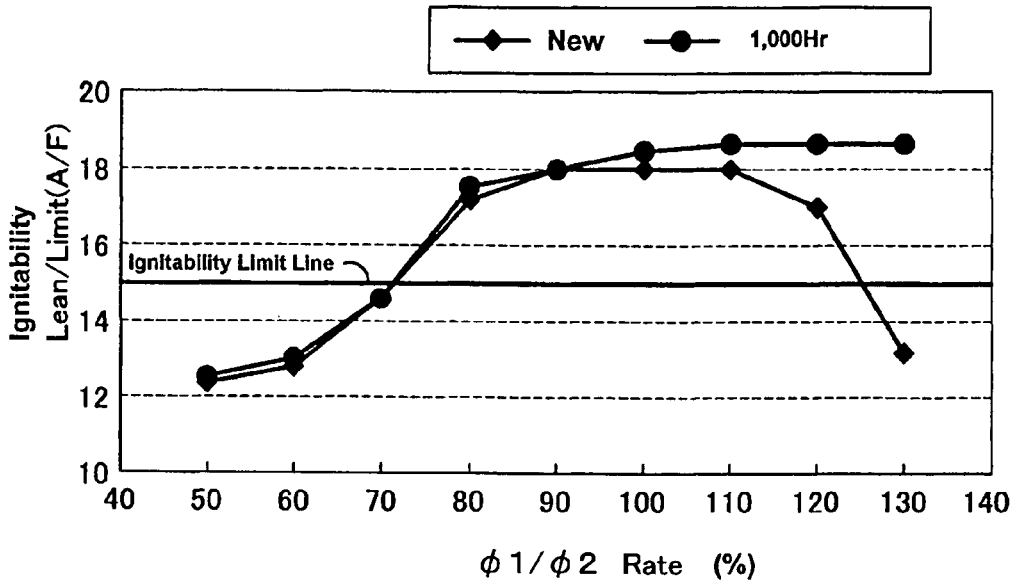
FIG. 8 is an explanatory view showing an example of the ignitability evaluation result according to an embodiment of the present invention.
Figure 9A:
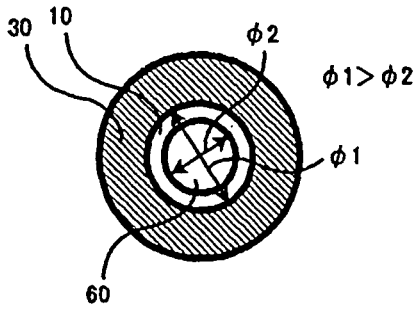
FIG. 9 is an explanatory view showing the opening 31 of the ground electrode 30 in FIG. 2 and the small diameter portion 15 front end of the ceramic insulator 10 when viewed from the front end side of the plasma jet spark plug 100.
Figure 9B:
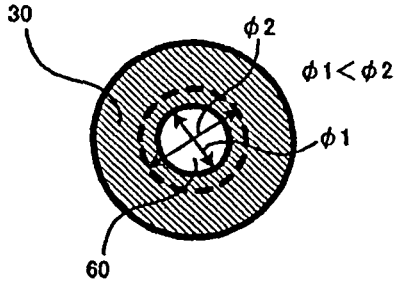
Figure 9C:
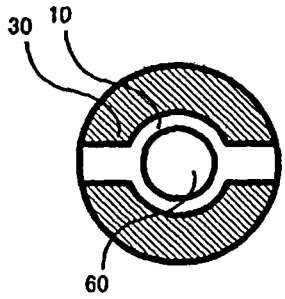
Figure 9D:
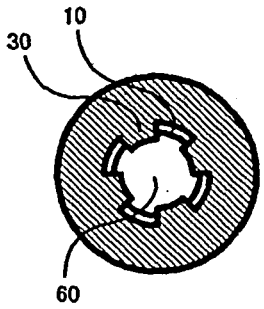

An example of the ignitability evaluation results in this embodiment will be described with reference to FIG. 8. FIG. 8 is an explanatory view showing an example of the ignitability evaluation results. In FIG. 8, a vertical axis shows an A/F (air/fuel) value at the misfire occurrence rate of 1% when an internal combustion engine is operated at no load (N/L) (820 rpm). A horizontal axis shows a ratio (m/n) (%) of the inner diameter "m" of the opening 31 to the inner diameter "n" of the front end of the small diameter portion 15 (i.e., the inner diameter of the cavity 60). The evaluation was conducted such that a sample having an A/F value beyond an ignition limit line (A/F=15) was determined acceptable. Unused (new) products and products subjected to 1,000 hours channeling durable process (1,000 Hr durable process) were used for the evaluation test. The 1,000 Hr channeling durable process was conducted in a 0.4 MPa pressure chamber at the frequency of 60 Hz so as to cause spark discharge (trigger discharge).

As shown clearly in FIG. 8, excellent ignitability is exhibited when the ratio of the inner diameter of the opening 31 to the inner diameter of the cavity 60 is 75% or more. However, as for the product subjected to 1,000 hours channeling durable process, the ignitability falls sharply as the ratio is larger than 120%. Therefore, excellent ignitability can be exhibited when the ratio falls within a range from 75% to 120%.

In this embodiment, the opening 31 of the ground electrode 30 can take various forms with respect to the cavity 60 as shown in FIGS. 9(*a*)-9(*d*). FIGS. 9(*a*)-9(*d*) are views showing various embodiments of opening 31 of the ground electrodes 30 in FIG. 2 and the front end of the small diameter portion 15 of the ceramic insulator 10 when viewed from the front end side of the plasma jet spark plug 100.

In FIG. 9(*a*), the inner diameter "m" of the opening 31 of a ground electrode 30 is made larger than the inner diameter "n" of the front end of the small diameter portion 15 of the ceramic insulator 10 (i.e., the inner diameter of the cavity 60). On the contrary, FIG. 9(*b*) shows the inner diameter "m" of the opening 31 of a ground electrode 30 made smaller than the inner diameter "n" of the front end of the small diameter portion 15 of the ceramic insulator 10. Further, FIG. 9(*c*) shows a ground electrode 30 where a part of the inner circumference of the opening 31 is exposed and connected to the outer circumference of the ground electrode 30. Furthermore, FIG. 9(*d*) shows a ground electrode 30 having a plurality of protrusions along the inner circumference of the opening 31 of the ground electrode 30.

C-5. Polarity of Center Electrode

In this embodiment, the center electrode 20 serves as a negative electrode to the ground electrode 30.

Figure 10A:
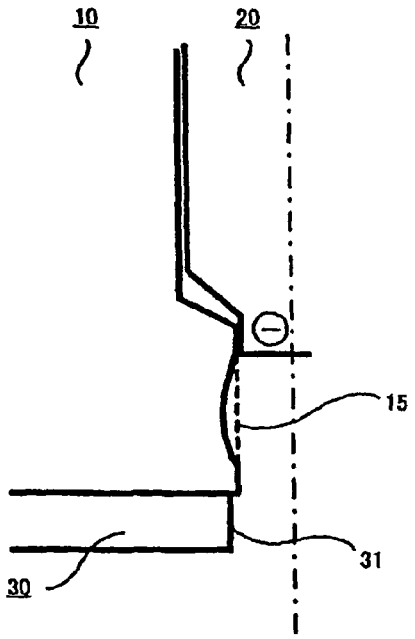
FIG. 10 is an explanatory view showing a difference in channeling progress due to difference in polarity of the center electrode 20 in FIG. 2.
Figure 10B:
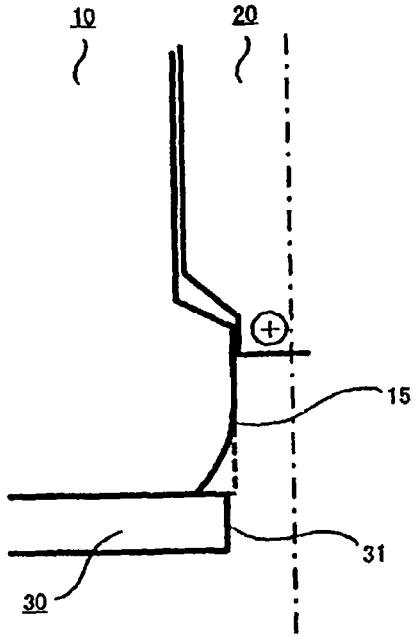

FIGS. 10(*a*) and 10(*b*) are explanatory views showing a difference in channeling progress resulting from a difference in polarity of the center electrode 20 in FIG. 2. FIG. 10(*a*) shows a case where the center electrode 20 serves as a negative electrode, and FIG. 10(*b*) shows a case where the center electrode 20 serves as a positive electrode.

Generally, as shown in FIG. 10(*b*), since the channeling progress is greater at the negative electrode, the front end of the small diameter portion 15 of the ceramic insulator 10 tends to be eroded due to channeling phenomenon when the center electrode 20 serves as the positive electrode to the ground electrode 30. Thus, a discharge path is established towards a bottom surface side of the ground electrode 30. This causes deterioration in ignitability. On the other hand, as shown in FIG. 10(*a*), the front end of the small diameter portion 15 is not eroded when the center electrode 20 serves as the negative electrode to the ground electrode 30. However, in the inner circumference of the small diameter portion 15, a portion close to the front end of the center electrode 20 tends to be eroded. In such a case, the discharge path first goes to the outer circumference side and then to the inner circumference side in the radial direction. This results in preventing deterioration in ignitability due to channeling progress.

Figure 11:
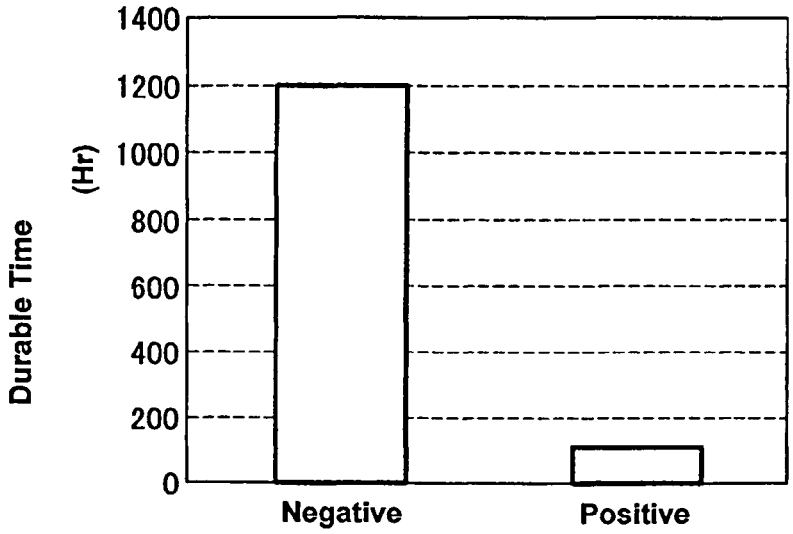
FIG. 11 is an explanatory view showing a difference in ignitability level durable time due to difference in polarity of the center electrode 20.

Referring now to FIG. 11, difference in ignitability level sustaining time according to a polarity of the center electrode 20 will be described. FIG. 11 is an explanatory view showing a difference in ignitability level sustaining time in relation to the polarity of the center electrode 20. In FIG. 11, a vertical axis shows a durable time under channeling durable conditions. More particularly, this durable time is defined as a period of time until an A/F (air/fuel) value at the misfire occurrence rate of 1% becomes less than 15, when an internal combustion engine is operated at no load (N/L) (820 rpm). Similar to FIG. 8, the channeling durable process was conducted in a 0.4 MPa pressure chamber at the frequency of 60 Hz so as to cause spark discharge (trigger discharge).

It is clear from FIG. 11 that the ignitability level sustaining time is remarkably improved when the center electrode 20 serves as a negative electrode to the ground electrode 30.

Figure 12:
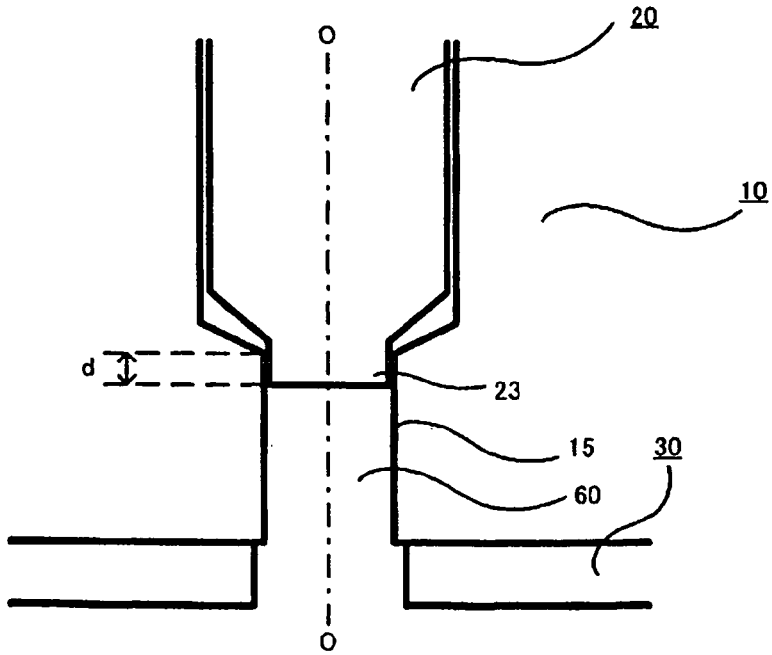
FIG. 12 is an explanatory view showing an overlapping condition of the small diameter portion 15 of the ceramic insulator 10 and the frontmost portion 23 of the center electrode 20 in FIG. 2.

C-6. Overlapping of Ceramic Insulator Small Diameter Portion with Center Electrode Frontmost Portion FIG. 12 is an explanatory view showing an overlapping status of the small diameter portion 15 of the ceramic insulator 10 and the frontmost portion 23 of the center electrode 20 in FIG. 2. As shown in FIG. 12, an overlapping amount "d" of the small diameter portion 15 of the ceramic insulator 10 with the frontmost portion 23 of the center electrode 20 in the axis O direction falls within the range from 0.5 to 3 mm.

Figure 13:
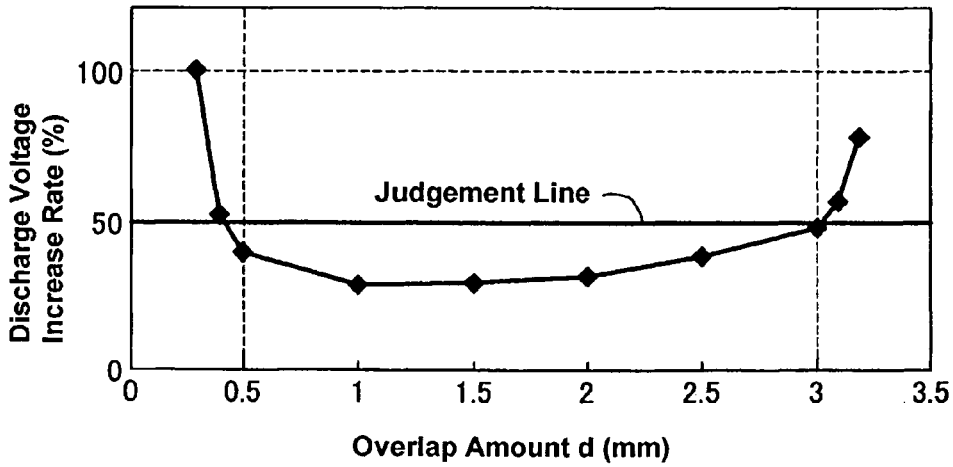
FIG. 13 is an explanatory view showing the spark discharge voltage increase rate due to difference in overlapping amount of the small diameter portion 15 of the ceramic insulator 10 with the frontmost portion 23 of the center electrode 20.

FIG. 13 is an explanatory view showing the spark discharge voltage increase rate due to difference in overlapping amount of the small diameter portion 15 of the ceramic insulator 10 with the frontmost portion 23 of the center electrode 20. In FIG. 13, a vertical axis shows an electric discharge voltage increase rate (%) after the plasma durability test, and horizontal axis shows the overlapping amount "d" of the small diameter portion 15 of the ceramic insulator 10 with the frontmost portion 23 of the center electrode 20. In addition, the plasma durability test was conducted at the frequency of 60 Hz for 100 hours (60 Hz×100 Hr) with 118 mJ, and the chamber pressure power of 0.4 mPa. The judgment line of the spark discharge voltage increase rate was 50%.

When the overlapping-amount "d" is smaller than 0.5 mm, and when the frontmost portion 23 of the center electrode 20 has an electrode-erosion, such electrode-erosion progresses to a portion which is not overlapped with the small diameter portion 15 of the ceramic insulator 10. This causes an aerial discharge and a creeping discharge, thereby resulting in a sharp increase in spark discharge voltage as shown in FIG. 13.

When the overlapping amount "d" is larger than 3 mm, the heat conduction of the center electrode 20 deteriorates, and an oxidation of the center electrode 20 remarkably advances. As a result, a sharp increase in spark discharge voltage occurs.

On the other hand, when the overlapping amount "d" is within the range from 0.5 to 3 mm, a form of electric discharge becomes a creeping discharge, which results in preventing an increase in spark discharge voltage.

C-7. Angle of Step Portion

Figure 14A:
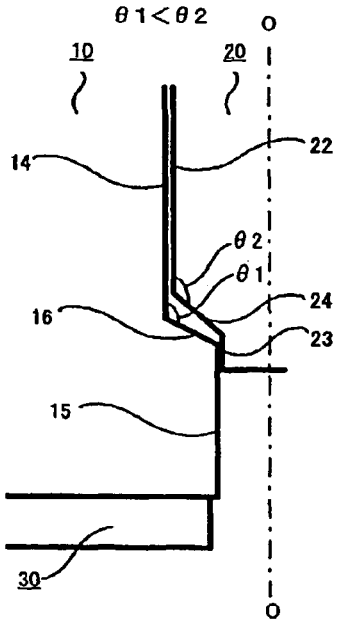
FIG. 14 is an enlarged sectional view showing around the step portion 16 of the ceramic insulator 10 and the step portion 24 of the center electrode 20 in FIG. 2.
Figure 14B:
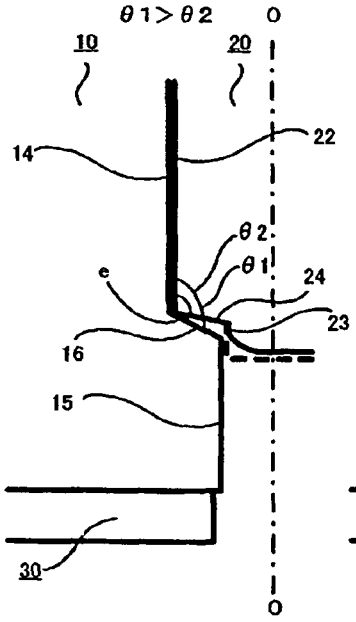
Figure 14C:
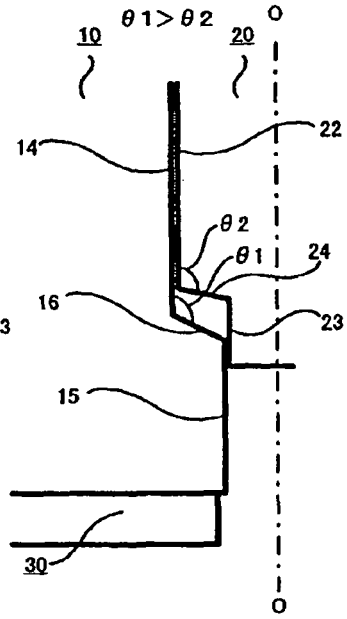

FIG. 14 is an enlarged sectional view showing around the step portion 16 of the ceramic insulator 10 and the step portion 24 of the center electrode 20 in FIG. 2. In this embodiment, as shown in FIG. 14(*a*), angles θ1 and θ2 satisfies the following relationship: θ1<θ2, where θ1 represents an angle formed by the step portion 16 and the accommodating portion 14 of the ceramic insulator 10, and where θ2 represents an angle formed by the step portion 24 and the front end portion 22 of the center electrode 20.

On the other hand, as shown in FIG. 14(*b*), when the relationship between the θ1, which is formed by the step portion 16 and the accommodating portion 14, and the θ2, which is formed by the step portion 24 and the front end portion 22, is θ1>θ2 under the conditions that a length of the frontmost portion 23 of the center electrode 20 in the axis O direction is the same as in the case of FIG. 14(*a*). In these conditions, an electrical field concentrates on a point "e" when the frontmost portion 23 of the center electrode 20 is eroded. Thus, the point "e" tends to be a starting point of electric discharge between the center electrode 20 and the ground electrodes 30. Therefore, the step portion 16 and the small diameter portion 15 of the ceramic insulator 10 tend to be eroded.

Moreover, as shown in FIG. 14(*c*), when the relationship between the angle θ1 and the angle θ2 is θ1>θ2, as well as the length of the frontmost portion 23 of the center electrode 20 in the axis O direction is extended longer than that of the case in FIG. 14(*a*), an influence by the erosion of the frontmost portion 23 of the center electrode 20 is ameliorated. However, the heat conduction of the front end of the center electrode 20 deteriorates because the length of the frontmost portion 23 becomes long. Thus, the front end of the center electrode 20 tends to be eroded, thereby widening a space between the step portion 16 and the step portion 24. As a result, a combustion gas is likely to be pooled in this space.

C-8. Shape of Cavity

Figure 15:
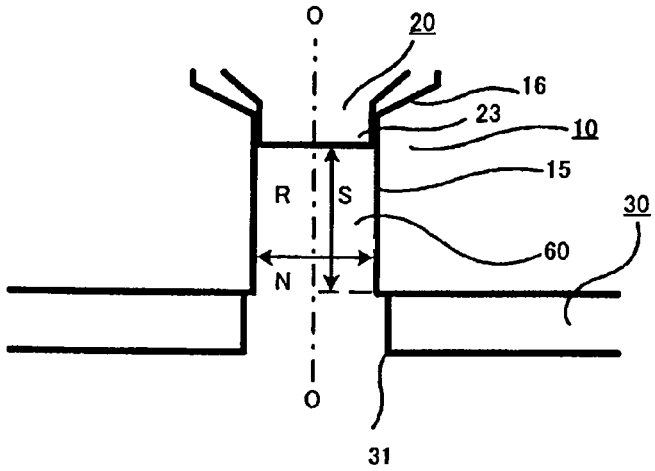
FIG. 15 is an enlarged sectional view showing a cavity 60 in FIG. 2.

FIG. 15 is an enlarged sectional view showing the cavity 60 in FIG. 2. In this embodiment, as shown in FIG. 15, the following relationships are satisfied: R≦2.5 mm$^3$, and S/N≧0.3, where "R" represents a volume of the cavity 60, "S" represents a length of the cavity 60 in the axis O direction, and "N" represents an inner diameter of the cavity 60 (i.e., the inner diameter of the small diameter portion 15 of the ceramic insulator 10).

By defining the volume R, the length S, and the inner diameter N of the cavity 60 in the respective range, the excellent ignitability is achievable.

Figure 16:
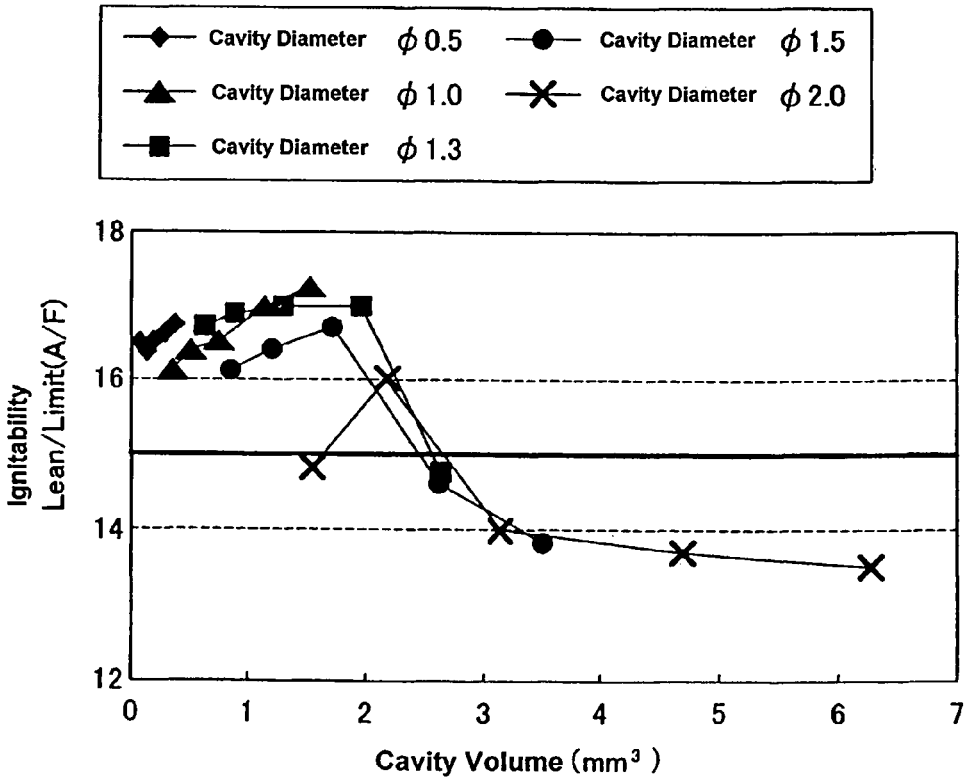
FIG. 16 is an explanatory view showing evaluation results of the ignitability in relation to a different shape of the cavity 60 in FIG. 2.

FIG. 16 is an explanatory view showing evaluation results of the ignitability in relation to difference in shape of the cavity 60 in FIG. 2. In FIG. 16, similar to the case of FIG. 8, a vertical axis shows an A/F (air/fuel) value at the misfire occurrence rate of 1% when an internal combustion engine is operated at no load (N/L) (820 rpm), and a horizontal axis shows the volume R of the cavity 60 (mm$^3$). The graph shows five cases where the inner diameter N (mm) of the cavity 60 is ϕ0.5, ϕ1.0, ϕ1.3, ϕ1.5, and ϕ2.0, respectively. In addition, similar to the case of FIG. 8, the evaluation was conducted such that a sample having an A/F value beyond an ignition limit line (A/F=15) was determined acceptable.

As is clear from FIG. 16, the ignitability dramatically deteriorates when the volume R of the cavity 60 exceeds 2.5 mm$^3$. Further, when the inner diameter N of the cavity 60 is ϕ2.0 mm, and the volume R thereof is 2 mm$^3$ or less, the ignitability also deteriorates. This is because the ratio of the inner diameter N to the length S varies as the inner diameter N of the cavity 60 is large.

As for all the data in FIG. 16, the samples having low ignitability shows that the ratio of the length S to the inner diameter N of the cavity 60 is 0.25 or less when the volume R of the cavity 60 is 2.5 mm$^3$ or less. However, the samples having the ratio of 0.3 or more, the ignitability does not deteriorate.

Therefore, excellent ignitability is achievable when the volume R of the cavity 60 is 2.5 mm$^3$ or less and the ratio of the length S to the inner diameter N of the cavity 60 is 0.3 or more.

C-9. Gap between Step Portions

In the embodiment shown in FIG. 2, a gap is provided between the step portion 16 of the ceramic insulator 10 and the step portion 24 of the center electrode 20. In this way, the heat in the end portion of the ceramic insulator 10 is unlikely conducted to the center electrode 20, whereby an increase in temperature of the tip end of the center electrode 20 can be prevented.

C-10. Material of Tip End of Center Electrode

In this embodiment, the tip end of the center electrode 20 is made of tungsten or a tungsten alloy as mentioned above. Thus, when plasma current is fed to the plasma jet spark plug 100, the tip end of the center electrode is unlikely melt. Further, the tip end of the center electrode 20 may be made of pure metal or an alloy with a melting point of 2400 degrees C. or more in addition to tungsten or a tungsten alloy.

D. Modification

The present invention is not particularly limited to the embodiments described above but may be modified in various ways within the scope of the invention.

In the above-mentioned embodiment, although the features C-1 to C-10 are mentioned, the present invention is not limited to the above embodiment. That is, the present invention can have at least features C-1 and C-2, and it is not necessary to have other features. Furthermore, when other features are included in the present invention, the combination thereof can be arbitrarily selected.

The invention claimed is:

1. A plasma jet spark plug comprising:

a cylindrical insulator having an axial bore extending in an axis direction;

a rod-like center electrode accommodated in the axial bore of the insulator;

a plate-like ground electrode disposed on a front end of the insulator, wherein the center electrode has a body portion, a forward portion that has an outer diameter smaller than that of the body portion and that is located on a front end side with respect to the body portion, and a frontmost portion having an outer diameter smaller than that of the forward portion and located on a front end side with respect to the forward portion, wherein a portion of the insulator where the axial bore is formed has:

an accommodating portion having an inner diameter smaller than the outer diameter of the body portion of the center electrode, said accommodating portion accommodating therein at least the forward portion of the center electrode, and a small diameter portion having an inner diameter smaller than the outer diameter of the forward portion of the center electrode and smaller than the inner diameter of the accommodating portion, the small diameter portion located on the front end side with respect to the accommodating portion and accommodating therein at least the frontmost portion of the center electrode, wherein the frontmost portion of the center electrode is accommodated in the small diameter portion of the insulator such that a front end of the center electrode is located in the small diameter portion of the insulator toward a rear side such that the front end of the center electrode is spaced from a front end of the insulator wherein the front end of the center electrode forms a cavity with an inner circumference of the small diameter portion of the insulator, wherein the ground electrode has an opening for use in communicating the cavity and an outside air, wherein the small diameter portion of the insulator in the axis direction assumes a linear shape, and wherein the portion of the insulator where the axial bore is formed further includes a first step portion located between the accommodating portion and the small diameter portion, wherein the following relationship is satisfied:

$$0.2 \leqq (2c)/(a+b) \leqq 4,$$

where "a" represents a distance between a first intersection and a second intersection, the first intersection being an intersection of a first straight line drawn from an inner circumference of the opening of the ground electrode in the axis direction and the front end of the insulator, and a second intersection being an intersection of the first straight line and the first step portion of the insulator, when the inner diameter of the opening of the ground electrode is smaller than the outer diameter of the forward portion of the center electrode and is larger than the inner diameter of the small diameter portion of the insulator, where "a" represents a length of an inner circumferential surface of the small diameter portion of the insulator in the axis direction when the inner diameter of the opening of the ground electrode is smaller than the outer diameter of the forward portion of the center electrode and is smaller than the inner diameter of the small diameter portion of the insulator, where "b" represents a distance between a third intersection and a fourth intersection, the third intersection being an intersection of a second straight line drawn from the outer circumference of the forward portion of the center electrode in the axis direction and the first step portion of the insulator, and the fourth intersection being an intersection of the second straight line and the front end of the insulator, and where "c" represents an overlapping area of the ground electrode with the forward portion of the center electrode when the ground electrode and the forward portion of the center electrode are projected in the axis direction.

2. The plasma jet spark plug according to claim 1, wherein the inner diameter of the opening of the ground electrode falls within a range from 75% to 120% of the inner diameter of the front end of the small diameter portion of the insulator.

3. The plasma jet spark plug according to claim 1, wherein the center electrode serves as a negative electrode.

4. The plasma jet spark plug according to claim 1, wherein an overlapping amount of the frontmost portion with the small diameter portion in the axis direction falls within the range from 0.5 to 3 mm.

5. The plasma jet spark plug according to claim 1, wherein the center electrode further includes a second step portion between the forward portion and the frontmost portion, and wherein angles θ1 and θ2 satisfies the following relationship:

$$\theta 1 < \theta 2,$$

where θ1 represents an angle formed by the first step portion and the accommodating portion, and where θ2 represents an angle formed by the second step portion and the front end forward portion.

6. The plasma jet spark plug according to claim 5, wherein a gap is provided between the first step portion and the second step portion.

7. The plasma jet spark plug according to claim 1, wherein the following relationships are satisfied:

$$R \leqq 2.5\ \mathrm{mm}^3, \text{ and}$$

$$S/N \geqq 0.3,$$

where "R" represents a volume of the cavity, where "S" represents a length of the cavity in the axis direction, and where "N" represents an inner diameter of the small diameter portion.

8. The plasma jet spark plug according to claim 1, wherein at least a tip end of the center electrode is made of pure metal or an alloy with a melting point of 2400 degrees C. or more.

9. The plasma jet spark plug according to claim 1, wherein at least the tip end of the center electrode is made of tungsten or a tungsten alloy.

* * * * *